United States Patent [19]

Poupko

[11] 4,236,460

[45] Dec. 2, 1980

[54] FOLDABLE FURNITURE SYSTEM

[76] Inventor: Felice Poupko, 22 Earl St., Waterbury, Conn. 06710

[21] Appl. No.: 959,316

[22] Filed: Nov. 9, 1978

[51] Int. Cl.[3] ..... A47B 3/00

[52] U.S. Cl. ..... 108/41; 312/258; 108/111

[58] Field of Search ..... 108/41, 33, 112, 115, 108/111, 113; 312/258

[56] References Cited

U.S. PATENT DOCUMENTS

| | | | |
|---|---|---|---|
| 2,510,243 | 6/1950 | Mohring | 108/111 X |
| 2,771,334 | 11/1956 | Wahlbom | 108/112 X |
| 3,464,372 | 9/1969 | Fiterman et al. | 108/111 X |
| 3,955,864 | 5/1976 | MacDonald | 312/258 |
| 4,082,389 | 4/1978 | Stewart | 312/258 |
| 4,099,809 | 7/1978 | Leotta | 312/258 |

FOREIGN PATENT DOCUMENTS

| | | | |
|---|---|---|---|
| 250145 | 8/1947 | Switzerland | 108/115 |

*Primary Examiner*—Roy D. Frazier
*Assistant Examiner*—Peter A. Aschenbrenner
*Attorney, Agent, or Firm*—Eliot S. Gerber

[57] ABSTRACT

A multifunctional folding furniture system includes a basic frame structure to which functional panels are removably attached. The frame consists of four stiles (uprights) connected by side rails to form side members, which members are removably and rotationally connected to a back panel having two elongated slots to form the frame of the basic unit. Functional panels of various dimensions and configurations may be removably and rotationally applied to the frame to create functional surfaces.

The complete system includes a number of frame units and separate panels, all of which may be interconnected to form a large variety of furniture pieces, including various arrangements of desks and tables.

7 Claims, 6 Drawing Figures

FOLDABLE FURNITURE SYSTEM

BACKGROUND OF THE INVENTION

It has been widely recognized that furniture pieces may be designed to serve more than one function or may be folded for storage. For example, a sofa may be opened to form a bed and the legs of a card table may be folded so that the card table may be conveniently stored.

There have been many patents issued in which a furniture piece may be folded for storage or may be connected, in various ways, to serve a number of functions. The number of different conventionally employed basic furniture components is limited. Such components generally include such items as legs, for example, upright stiles, cross-beam supports, panels used as shelves or as tops, hinges and fixed fasteners such as screws. However, these components may be arranged in countless numbers of ways, some of those arrangments being illustrated by the patents which are discussed below.

U.S. Pat. No. 2,615,711 for "Knockdown Table" shows a table having a top panel and four removable square "U" shaped members which serve as its legs and supports.

U.S. Pat. No. 2,110,068 for "Foldable Table" shows a table which may be folded to form a cabinet and unfolded, using hinged panels, to form a table.

U.S. Pat. No. 1,181,525 for "Convertible Kitchen Table, Ironing Board, Quilting Frame and Clothes Rack" shows a frame having detachable racks and a table top.

U.S. Pat. No. 3,744,845 for "Combination Bench, Stool, And Plaque Table" shows a frame of stiles and cross-pieces which are fixed and which may be turned on its side, or turned on its end, for various furniture uses.

U.S. Pat. No. 3,070,416 for "Secretarial Cabinet" shows a secretarial cabinet, including two fixed container members, which may be pivoted to form a box-like arrangement (FIG. 3) or opened to support a foldable top member.

In U.S. Pat. No. 2,122,969 for "Collapsible Table Cabinet" a cabinet structure having drawers utilizes pivotable panels which may be opened to form an enlarged table surface and an adjustable tiltable board.

In U.S. Pat. No. 2,549,242 for "Collapsible Combination Screen and Table" a foldable screeln, having foldable legs, may be opened and used as a table.

U.S. Pat. No. 3,070,138 for "Foldable Work-Bench" shows a frame structure having legs pivoted together and a foldable top.

U.S. Pat. No. 1,086,526 for "Article of Furniture" shows a bookcase having pivotable side panels which may be opened to act as a screen.

U.S. Pat. No. 2,764,462 for "Portable Collapsible Bar" shows a structure having a front panel, hinged side panels, a removable shelf and a removable top.

U.S. Pat. No. 409,947 for "Ironing Board and Table" shows a stand which may be turned for use as an ironing board.

U.S. Pat. No. 3,406,645 for "Prefabricated Furniture" shows library furniture which is assembled to form carrel units of different arrangements using slots and plugs.

OBJECTIVES AND FEATURES OF THE INVENTION

It is an objective of the present invention to provide furniture pieces which are capable of a number of uses and which are readily collapsible or foldable and yet, when erected, are structurally sound for their intended uses.

The furniture piece's specific use will be defined by the particular functional panel employed and the precise nature of its deployment.

The furniture piece remains completely versatile until application of the panel.

The furniture piece does not require locking joints and consequently it may be transformed from one use to another with relative ease.

Additionally, the furniture item may be folded to a compact dimension for easy storage.

It is a feature of the present invention to provide a multifunctional furniture unit. The basic single unit comprises a frame and two side panel members. The frame has first, second, third and fourth elongated stile members which are parallel to each other. A rear panel, having at least one elongated slot in a plane perpendicular to said elongated stiles, is pivotly attached at its opposite sides to respectively the second and third stile members. Means, such as hinges, are utilized to pivotly attach the second and third stile members to the rear panel. The basic single frame also comprises a first and a second side rail means which is pivotly connected to the stile members at opposite ends. The first side rail means is connected to the first and second stile members and the second rail means is connected to the second and third stile members. Means, such as screws, are used to non-pivotly attach the first and second side rail means between respectively the first and second and the third and fourth stile members. The single basic unit also comprises a first and a second side panel member. Each side panel is removably and pivotly connected to the frame at its opposite sides.

SUMMARY OF THE INVENTION

Accordingly, the furniture item of the present invention comprises a foldable frame member which is adapted to cooperate with functional panels of various dimensions and configurations. The frame members consists of four stile (upright) members which are interconnected by side and back rails. The first and second stiles and the third and fourth stiles are removably connected by placement of the side rails therebetween to form side members. The rails may be removably attached to the stiles by means of screws or other fasteners. These side members are removably and rotationally attached to the back rails to provide for the completed frame. Additionally, the side rails may be replaced by side panels.

The frame member cooperates with at least one panel to form various functional furniture items such as tables, desks, work areas and counters. Such panels may be positioned within stile cutouts or they may be removably and rotationally connected to the stiles.

Additional objectives and features of the present invention will be seen from the following description of the invention which, taken in conjunction with the accompanying drawings, represents the preferred embodiment of, and the best mode of practicing, the present invention.

DETAILED DESCRIPTION OF THE INVENTION

Figure 1:
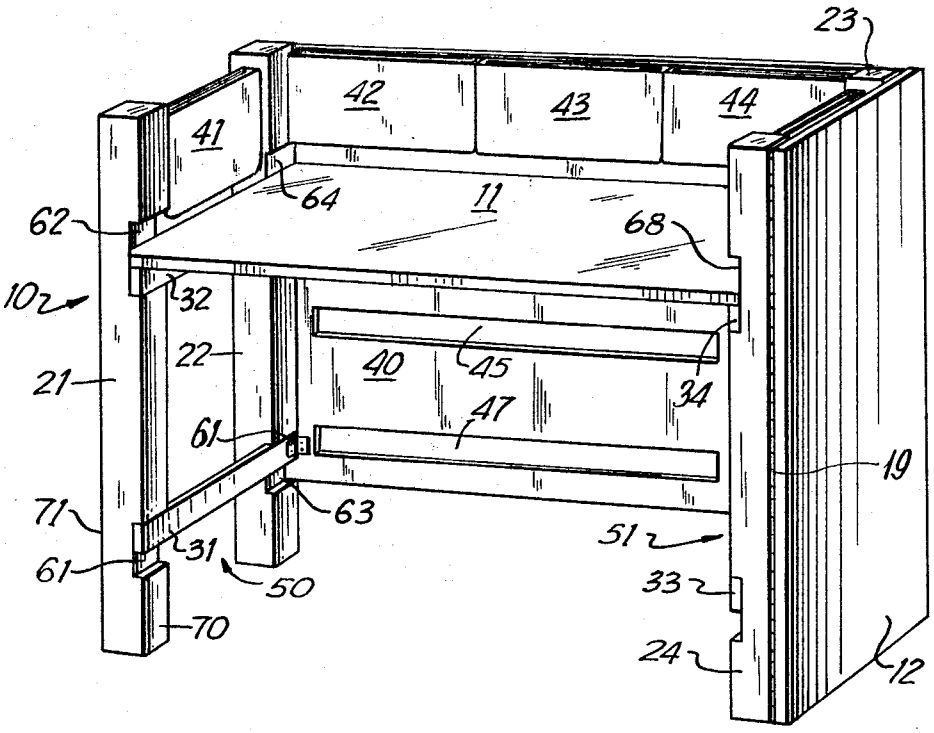
FIG. 1 is a perspective view of one folding furniture unit used as a child's desk.

As disclosed in FIG. 1, the folding unit of the present invention includes a frame member generally designated 10 and a plurality of panels 11,12 adapted to cooperate with the frame 10. The frame 10 includes a first stile (upright member) 21, a second stile 22, a third stile 23, and a fourth stile 24. The frame 10 further includes a first side rail 31, a second side rail 32, a third side rail 33, a fourth side rail 34 and a back rail 40.

The first and second stiles 21,22 are removably connected to each other by the first and second side rails 31,32 which are removably attached, by screws or other fastening means, to stiles 21,22. Such connection forms a first frame side member 50. A similar connection is made between the third and fourth stiles 23,24 and the third and fourth side rails 33,34 to form second frame side member 51.

The first stile 21 contains a plurality of cutouts (squared-off depressions) 61,62 which provide a recessed insertion means for the side rails 31,32. These cutouts 61,62 may be formed by routering or similar techniques well known in the art.

In addition to serving as rail recesses, the cutout 61,62 may also function as functional panel attachment means. As shown, a panel 11 is slipped within the parallel cutouts 62,64,66 (not seen in FIG. 1), 68 of the individual stiles 21,22,23,24 respectively.

The dimension of the cutout is specified by its functional application. For example, if it is to accept both the panel and the rail, the dimension must be slightly greater than the sum of the panel thickness and the rail width and a fastener which removably secures a panel.

The cutouts are generally formed on the inside face 70 of the stile to cooperate with the panel members. However, alternatively and not shown, the cutout may be on the outside stile face 71, if the stile has sufficient thickness, where it may function as a rail recess or panel acceptance groove when two or more units are combined.

Other functional panels 12 may additionally be removably and rotatively attached to the stiles 21,22,23,24 to provide a variety of functional applications. The first and second frame side members 50,51 are pivotally connected at opposite side ends of back panel 40. The back panel 40 has elongated slots 45,47 which are separated from each other and parallel, those slots 45,47 being perpendicular to the axis of stiles 22,23. The slots 45,47 could also be so positioned that when two units are used in different heights (one unit turned upside down), as explained below, the slots will still be level for an interconnecting panel.

Figure 2:
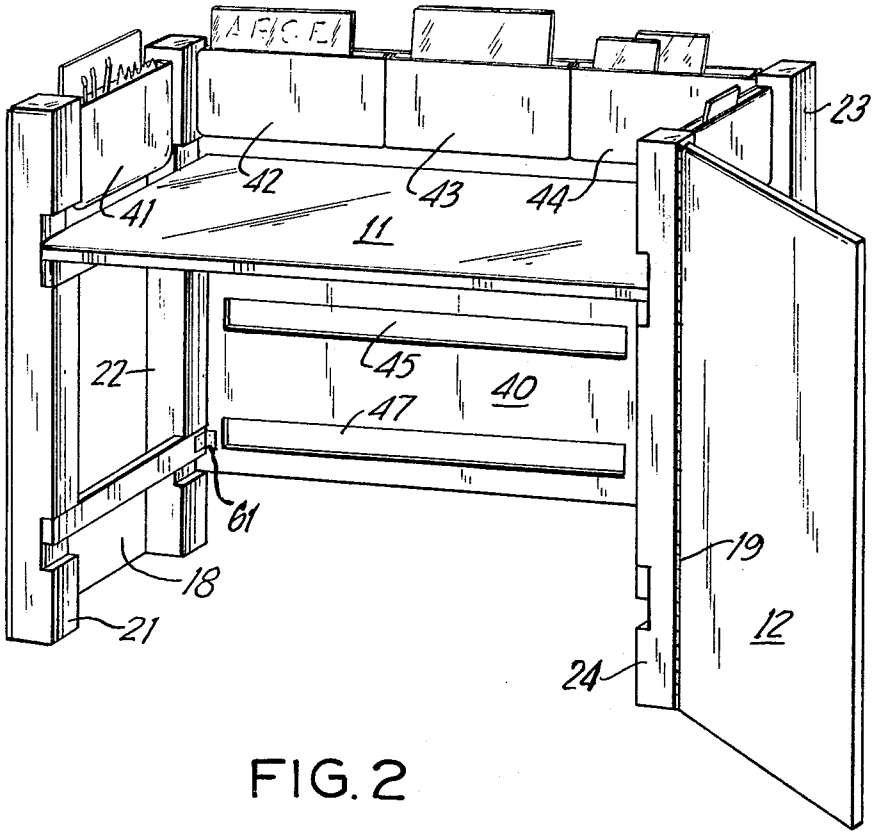
FIG. 2 is a perspective view of the furniture unit of FIG. 1 used as a child's work station.

FIG. 2 shows the side panel 12 in an articulated position which may be employed to support a plurality of detachable storage compartments. FIG. 2 shows such compartments as placed between stiles 21,22,23 and 24.

Figure 4:
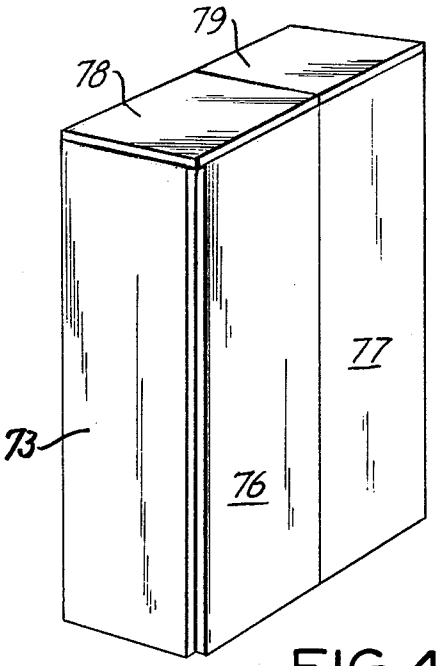
FIG. 4 is a perspective view of the entire system folded and used as a side table.

FIG. 4 indicates the embodiment of the present invention which is employed as a side table for adults. Frame 10 is folded from the position in FIG. 1 and enclosed in the table.

In the embodiment shown in FIG. 2, the side panel 12 has been pivoted on its hinge 19, which hinges panel 12 to stile 24. A second panel 18, hinged to stile 21, rests flat against the stiles 21,22 and is not pivoted outwardly.

Figure 5:
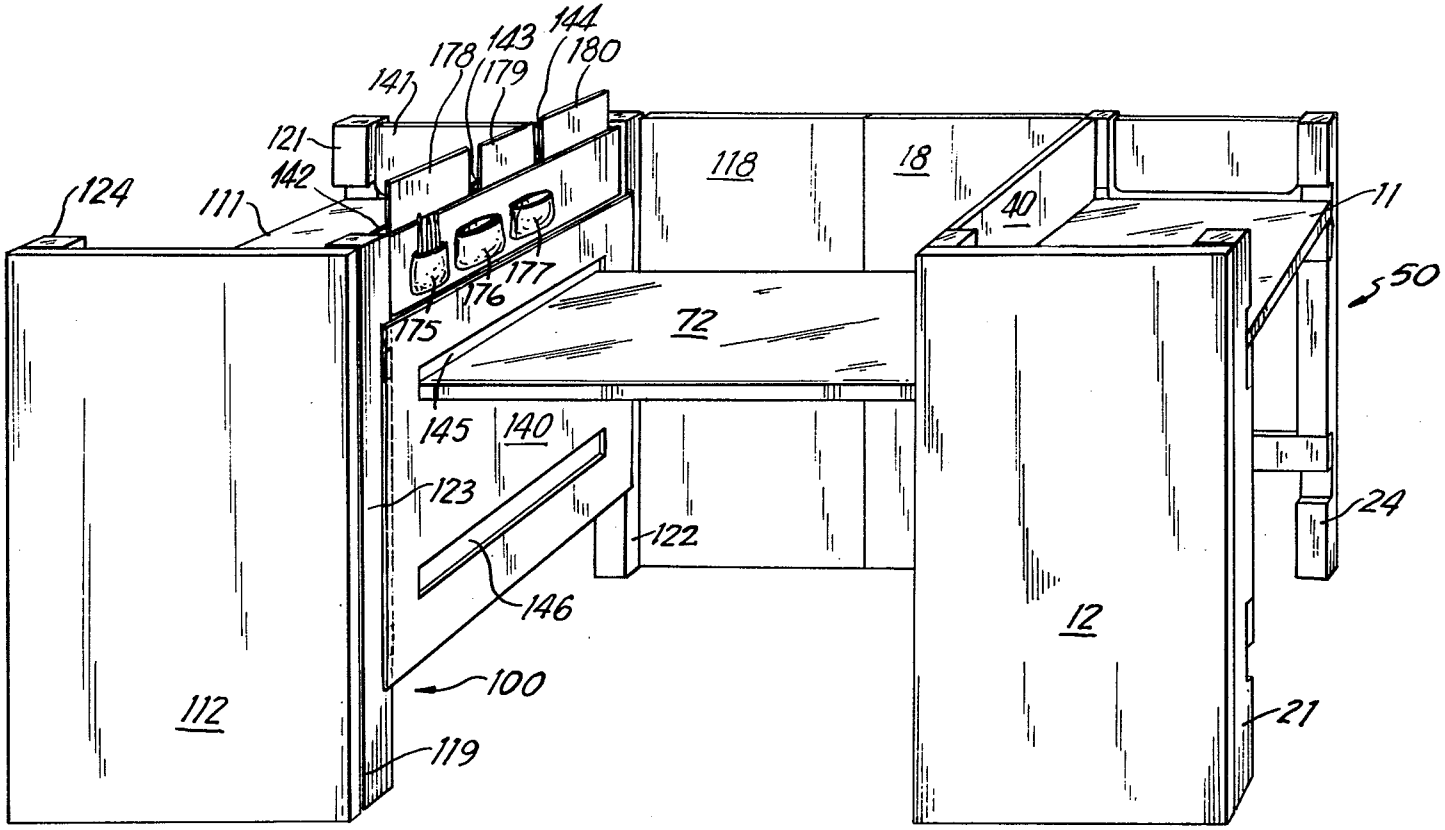
FIG. 5 is perspective view of two folding furniture units and a separate panel which are connected to form a children's workstation in two levels.

In the embodiment shown in FIG. 5, the first unit 50 is joined to a second unit 100 in which the corresponding parts are numbered in the "100" series. In both units 50 and 100 the side panels 12,112 are flat against their corresponding stiles and are not pivoted outwardly. However, the opposite side panels 18,118 are pivoted 180° and abut each other along their long free edges.

A flat panel 72 is positioned on the bottom edges of the two slots 45,145 with opposite ends of the panel 72 in the respective slots 45 and 145. The back of the pouches 142,143 and 144 is provided with small cloth pouches 175,176,177. The back pouches 42,43,44 or 142,143,144 could also be made in one piece. They may be sufficiently roomy to hold children's coloring books, story books, drawing paper, etc. or, if used for adults, writing, typewriter paper, envelopes, etc. The small pouches (cloth or other textile) 175,176,177) could be of various configurations and may also be sufficiently roomy to hold children's books, drawing paper, etc. For example, the bags may be made to adjust to become different sizes to accommodate different desk heights by using snaps, buttons or "Velcro" (TM) fasteners along its sides. The bags need not be removed to fold the unit for storage. However, the bags may easily be removed as they may be connected by turnbuttons or similar types of fasteners. The bags, if made of a suitable material such as reversible quilting, may be opened and used as place mats. The pouches 142–144 may be sufficiently roomy to hold coloring books, drawing paper, etc., and may have decorative or informative cards 178,179,180, respectively, which proturde above their top edges.

The frame side members are removably and rotatively attached to the back portion 40 by first hinge 61, second hinge 62 (not shown), third hinge 63 (not shown), fourth hinge 64, or other similar rotative attachment means.

The above description is detailed with respect to side rails 31,32,33,34 and back portion or panel 40 is not limited to the embodiments shown. The first side frame member 50 could easily be fabricated from a side panel similar to rear portion 40 interconnected with the first and second stiles 21,22. Similarly, the rear portion 40 may also be comprised of a plurality of individual rails. Additionally, the side or rear portions, which include cutouts or vents 42,43,44, decrease the overall structure weight and provide for a decorative and functional appearance and may be constructed of individual pieces rather than a continuous panel.

The numerous possible orientations of the frame member will provide for a variety of different furniture configurations such as work tables, child's tables, utility tables, cocktail tables or check writing tables.

The various panels of the present invention may be formed in various ways and may be covered with various materials. For example, the panels may be plywood panels that are covered on both sides, and its ends, by a laminated layer of rigid plastic resin composition such as "Formica," a trademark of American Cyanamid Co. Or one side of the panel may have such a plastic resin laminate and the opposite side may be covered by a fabric adhered to the panel. Alternatively, the cores of the panels may be formed of a rigid plastic resin foam, such as rigid polystyrene foam or rigid polyurethane foam, and the cores laminated to exterior layers of polyester coated woven fiberglass, or drawn "ABS" plastic resin, or an exterior layer of polyurethane.

It is also possible, although not shown, to provide for drawers on the panels. Such drawers may be, in effect, foldable pouches of textile material. Alternatively, the drawers may be foldable and constructed of rigid sides and bottom panel members. The panels may alternatively have attached thereto large cloth or other textile pouches to form storage bags.

The following is a list of the various panels and frame members which comprise a complete unit (a complete system as shown in its folded position in FIG. 4) and in an open top view in FIG. 6 with the two 9"×15" panels, of (v) below, removed.

Figure 6:
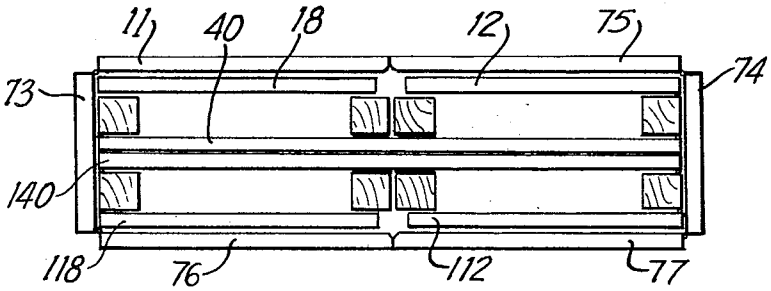
FIG. 6 is a top view of the folding unit folded as shown in FIG. 4 but with the two top panels removed.

(i) 2 panels each 9" wide (see 73 and 74 in FIG. 6);
(ii) 4 panels each 14⅛" long (see 12,18 and 112,118);
(iii) 4 panels each 15" long (see 11,75,76,77 in FIG. 6);
(iv) 2 folding frame units 50,100 each with respective back panels 40,140;
(v) 2 top panels 9"×15" (not shown in FIG. 6 but shown as 78,79 in FIG. 4)

The following constructions are possible using the complete furniture system;

1. A side table having a panel front and sides. This is the entire system with one unit folded as in FIG. 4 and the other unit behind it (inside and not seen).

Figure 3:
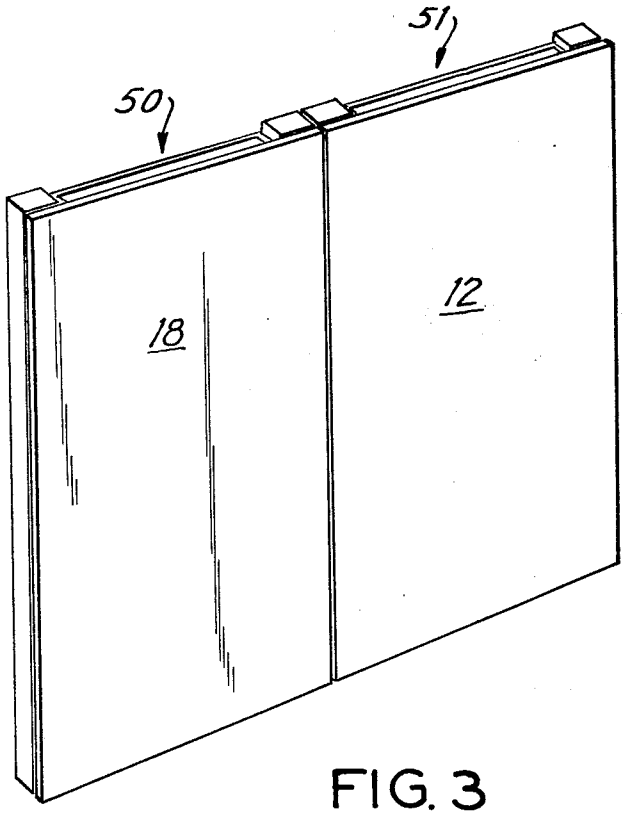
FIG. 3 is a perspective view of the folding unit of the present invention in a closed or folded position.

2. An unobtrusive wall panel. This is a single unit upright and folded as in FIG. 3.

3. A desk unit, as in FIG. 1, but with side panel 12 removed. The desk thus has two open frame sides.

4. A desk unit with one side panel attached (as in FIG. 1) but with such panel pivoted outwardly. This panel can be used to hold storage pockets, making the unit particularly suited to serve as a child's or adult's work center.

5. A single desk unit with single side panel attached and pivoted forward, with a counter top panel placed atop plane. Particularly suiting the unit to the child is the attachment of a child's cloth tree to one of the rear stiles, either 22 or 23. A suitable tree is comprised of an upright, for example, ¾-inch thick, and 2 inches wide, and 2'5" high, the bottom portion of which is attached to the upper portion of the stile, standing the upright in a plane parallel to that of the stile. The upright may be used for other constructions, may be removably secured and released by a releasable fastener means, and may fit, for storage, inside the folded unit of FIGS. 4 and 6.

6. Desk unit with two panel sides 12 and 18 attached (as in FIG. 2), but with both panels situated flat against their corresponding stiles (not pivoted outwardly). This would best serve as an adult or a child desk.

One or both of the side panels can be pivoted forwardly (as in FIG. 2) for additional versatility. Both panels pivoted forwardly an angle of at least 90° but less than 180° results in an excellent work center for a child. The faces of the forward panel can thus be used to attach pockets or compartments for storage.

7. The work center described above in paragraph 6 can also have a counter top on one or both of the side panels that have been pivoted outwardly. The counter top panel is situated atop the side panel in a plane perpendicular to it.

8. Two desk units with both side panels attached, and one sitting bench. The pieces of one entire unit, except for one 9" panel and one large panel, are utilzed in this construction. The bench is comprised of: the two counter top panels 91,92 utilized as upright sides standing in parallel planes; the 9" panel serving as the sitting surface lying in a plane perpendicular to the upright sides, sitting atop said panels 78,79 with the opposite ends of the panel supported by said uprights; a 15" panel utilized as the back panel of the bench, standing in a plane perpendicular to both the top and side panels.

9. A furniture system consisting of two desk units placed back to back, the side frame units standing next to one another in the same plane. Each desk unit has two side panels attached, each capable of being pivoted forwardly or situated flat against its corresponding side frame. The keeping of all four of the side panels flat against its corresponding stiles brings the two free edges of adjacent panels together, giving a neat appearance of one large panel on each side of the system.

10. A furniture system consisting of two children's work areas and one shelf. This comprises two desk units placed back to back (as in construction 9) but with all four side panels pivoted forwardly. On one side of the system these pivoted panels are used to support detachable storage compartments, becoming a part of the child's work center. On the opposite side of the system the side panels are each pivoted outwardly approximately 90° from their side frame and become the side frame of the adult's desk area. A panel is placed atop the parallel pivoted side panels, its opposite ends being supported by each of the side panels.

11. A furniture system again consisting of two children's work centers and adult work area. The construction of paragraph 10 is used, but the open side frame, left exposed in the paragraph 10 construction by the pivoting forward of the side panels for the child's work center, are now covered. Two panels are used in this construction, placed side by side in the same plane, each flying flat against the side frame of a desk unit. The result is a more aesthetically pleasing series of four adjacent panels on one side of the system.

12. A furniture system of two children's work centers sitting oppositely oriented along the same axis, interconnected by two shelves. The two desk units are situated in back-to-back positions with the distance between them being twice the width of the 14⅛" (or 13⅝") panels—see dimensions (any two panels from the system not already utilized in the work centers may be used as the shelves)—see FIG. 5. The two interconnecting panels lie in parallel planes, one atop the other. The upper shelf panel (which is one of the 14⅛" panels) utilizes the upper elongated slots 45,145 of the back panels 40,140 of the two desk units. The lower shelf panel (also one of the smaller 9" panels) utilizes the lower elongated slots 46,146 of the back panels, with opposite ends of the shelf panel sitting in the respective slots.

Each of the desk units has two side panels attached. On one side of the system the two side panels 12,112 are pivoted outwardly 180° and abut one another along their free edges. In so doing they form a backing for the shelves, standing perpendicular to them. The opposite side panels 18,118, however, are flat against their corresponding stiles and are not pivoted outwardly. These panels should be the smaller panels (ii) which are twice the height of their width minus the thickness of the back piece 40,140.

As an example of suitable dimensions of the complete unit, the stiles 21–24 and 121–124 are 2 feet 5 inches high; the back panels 40,140 are 29 inches wide (from the outer ends of the stiles 22,23 and 122,123 respectively); the elongated slots 45,46 and 145,146 are 24 inches long and are symmetrical with respect to the imaginary horizontal center plane (in respect to FIGS. 1 and 5) between them; the side panels 12,18 (112,118), of which there are four in the complete unit, are each 14½ inches wide and 2 feet 5 inches high, which width is the distance to the other edges of the stiles 23,24 (and 123,124) and 21,22 (and 121,122); and four other panels (such as panel 11) are each 13⅝ inches wide and 2 feet 5 inches high; two panels are each 9 inches wide and 2 feet 5 inches long; and two top panels are each 4½ inches wide and 9 inches long.

In general, the stiles and all the panels, including the 9″ panels but not the two short counter top panels, should all be the same height. Four of the panels should be twice the height of their width, for example, 15″×30″, to provide a flush and neat appearance when they are flat against the side frame. Four panels should be twice the height of their width minus the thickness of the back piece 40,140. This permits those panels to be flush with the front stiles when used as children's desk tops, as shown in FIG. 2 and, when the panels act as a support, are used to form the backing for shelves or center desk, as in FIG. 5. The thickness of the back panel 40,140 is preferably about the same as the depth of the cutout (¾″). The overall width of the back panel 40,140 should be the height of the panels and stiles, and slightly more than twice the width of the side frame.

The panels, when used as table tops, may be provided with fitted table covers of plastic or textile material which may be retained on the panels, when they are in the vertical position, i.e., when used as decorative side panels.

The twelve examples of various furniture constructions, set forth above, are illustrative of the many possible arrangements that are possible utilizing the units of the present invention.

What is claimed is:

1. A multifunctional furniture unit comprising a frame and two side panel members, said frame comprising:

first, second, third and fourth elongated stile members which are parallel to each other;

a rear panel attached at its opposite sides to said second and third stile members respectively, said rear panel having at least one elongated slot within which a panel of a second furniture unit is placed, said slot being in a plane which is perpendicular to said elongated stiles;

means to pivotally attach said second and third stile members to said rear panel portion;

a first and a second side rail means non-pivotally connected to said stile members at opposite ends of said side rail means, with said first side rail means having said first and second stile members connected thereto and said second rail means having said second and third stile members connected thereto;

means to non-pivotally attach said first and second side rail means between respectively said first and second and said third and fourth stile members;

said unit also comprising a first and a second side panel member removably and pivotally connected to said frame at respectively said first and fourth stile members to provide functional surfaces.

2. A multifunctional furniture unit comprising a first and a second frame, each of said first and second frames comprising:

first, second, third and fourth elongated stile members which are parallel to each other;

a rear panel having at least one elongated slot lying in a plane which is perpendicular to said elongated stiles, said rear panel being pivotally attached at its opposite sides to said second and third stile members, respectively;

means to pivotally attach said second and third stile members to said rear panel portion;

a first and a second side rail means non-pivotally connected to said stile members at opposite ends of said side rail means, with said first side rail means having said first and second stile members fixed thereto and said second rail means having said third and fourth stile members connected thereto;

means to non-pivotally attach said first and second side rail means between respectively said first and second and said third and fourth stile members;

a first and a second side panel member each removably and pivotally connected to said frame at respectively said first and fourth stile members to provide functional surfaces;

said unit further comprising a connecting rectangular panel connected at its opposite ends to each of said frames by fitting and resting within said rear panel slots of said frames.

3. A multifunctional furniture unit as in claims 1 or 2 wherein said rear panel has a second elongated slot which is parallel to said first elongated slot.

4. A multifunctional furniture unit as in claims 1 or 2 and further comprising fastener means to removably secure and release upon contact said first and second side panels to respectively said second and third stile members.

5. A multifunctional furniture unit as in claim 1 and further including a top panel removably secured at the ends of said stiles.

6. A multifunctional furniture unit as in claim 2 wherein each of said rear panels has a second elongated slot parallel to said first elongated slot and the unit further includes a second connecting rectangular panel connected at its opposite ends to each of said frames by fitting and resting within said second rear panel slots.

7. A multifunctional furniture unit as in claims 1 or 2 and further comprising fastener means to removably secure said first and second side panels to respectively said second and third stile members and also respectively to said first and fourth stile members.

* * * * *